US006948904B2

(12) United States Patent
Bunn et al.

(10) Patent No.: US 6,948,904 B2
(45) Date of Patent: Sep. 27, 2005

(54) HYDRAULICALLY ACTUATED CASING SLIP LIFTER WITH HINGED WRAP ARM ASSEMBLY

(76) Inventors: Jack Bunn, 221 Jeff, Houma, LA (US) 70361; Bob Hooper, 2358 Abbeville Hwy., Rayne, LA (US) 70578

( * ) Notice: Subject to any disclaimer, the term of this patent is extended or adjusted under 35 U.S.C. 154(b) by 139 days.

(21) Appl. No.: 10/164,306

(22) Filed: Jun. 7, 2002

(65) Prior Publication Data

US 2003/0227187 A1 Dec. 11, 2003

(51) Int. Cl.[7] ..... B66C 1/42

(52) U.S. Cl. ..... 414/729; 414/739; 414/917; 294/88; 294/106

(58) Field of Search ..... 294/86.4, 88, 99.1, 294/106, 102.2; 166/208, 217; 414/680, 700, 729, 733, 739, 917

(56) References Cited

U.S. PATENT DOCUMENTS

| | | | | | |
|---|---|---|---|---|---|
| 2,030,087 | A | | 2/1936 | Young et al. | 294/102.2 |
| 2,545,021 | A | * | 3/1951 | Coupland et al. | 414/622 |
| 2,641,816 | A | | 6/1953 | Liljestrand | 188/67 |
| 3,073,645 | A | * | 1/1963 | Behrens | 294/88 |
| 3,241,695 | A | * | 3/1966 | Bishop | 294/88 |
| 3,325,029 | A | * | 6/1967 | Rigsby | 294/88 |
| 3,760,469 | A | | 9/1973 | Brown | 81/57.18 |
| 3,929,368 | A | * | 12/1975 | Ryden et al. | 294/88 |
| 3,964,352 | A | * | 6/1976 | Dukes | 81/426 |
| 4,030,746 | A | * | 6/1977 | Langowski | 294/88 |
| 4,077,525 | A | * | 3/1978 | Callegari et al. | 414/23 |
| 4,253,219 | A | | 3/1981 | Krasnov | 294/102.2 |
| 4,268,082 | A | * | 5/1981 | Hooton | 294/88 |
| 4,274,778 | A | * | 6/1981 | Putnam et al. | 294/106 |
| 4,275,488 | A | | 6/1981 | Gray et al. | 294/102.2 |
| 4,340,116 | A | | 7/1982 | Weise | 166/217 |
| 4,511,168 | A | | 4/1985 | Haynes | 294/102.2 |
| 4,652,195 | A | * | 3/1987 | McArthur | 294/88 |
| 4,790,708 | A | * | 12/1988 | von Bennigsen-Mackiewicz et al. | 294/902 |
| 5,301,750 | A | | 4/1994 | Watkins | 166/208 |
| 5,562,386 | A | * | 10/1996 | Browning | 414/555 |
| 5,669,653 | A | | 9/1997 | Penisson | 294/88 |
| 6,224,112 | B1 | | 5/2001 | Eriksen et al. | 285/3 |
| 6,227,587 | B1 | | 5/2001 | Terral | 294/102.2 |

FOREIGN PATENT DOCUMENTS

| | | | |
|---|---|---|---|
| GB | 2121760 | * | 1/1984 |
| GB | 2128525 | * | 5/1984 |

* cited by examiner

*Primary Examiner*—Eileen D. Lillis
*Assistant Examiner*—Paul T. Chin
(74) *Attorney, Agent, or Firm*—Bacon & Thomas, PLLC

(57) ABSTRACT

A casing slip lifter includes a frame, upper and lower lift arm assemblies, at least one air cylinder connected to a pipe that rotates to pivot the arm assemblies, and a wrap arm to which the slips are attached and which is coupled to the arm assemblies by a hinge. The arm assemblies include mutually pivotable plates, one of which may be latched to enable the arm assemblies to be raised into one of two raised positions, depending on which the lower arm assembly is locked. The higher position permits the casing lifter to be used when centralizers are installed on the casing.

3 Claims, 6 Drawing Sheets

LIFT IN THE LOCK POSITION

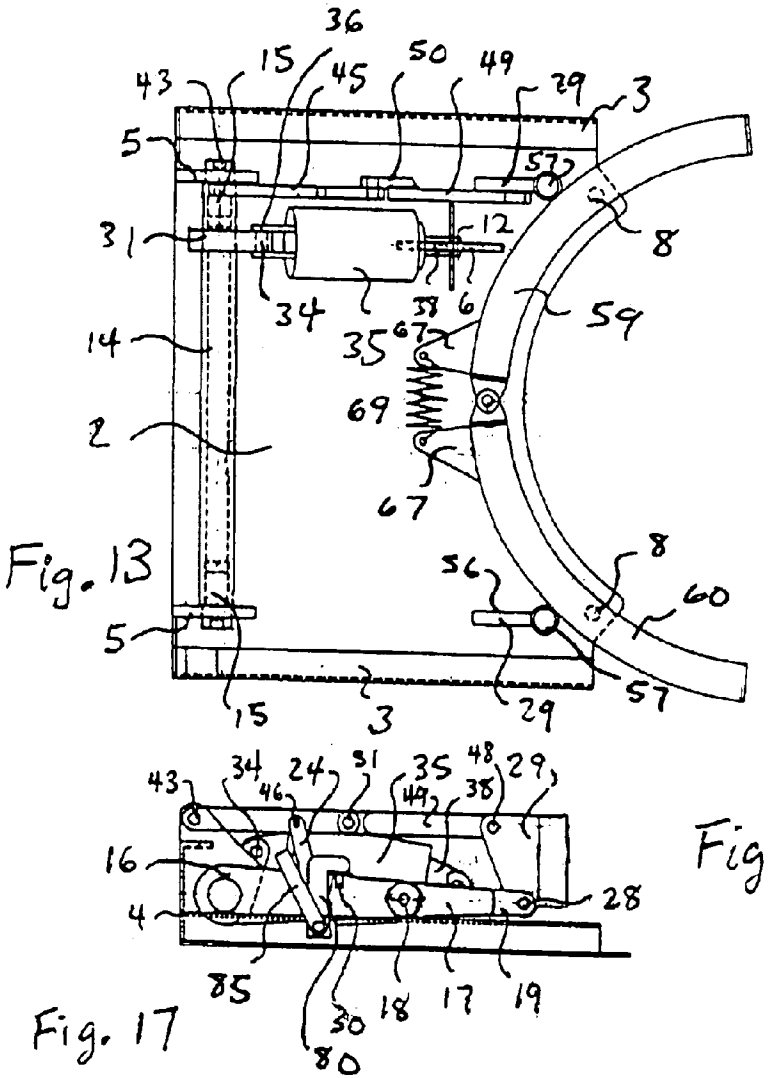
Fig. 13
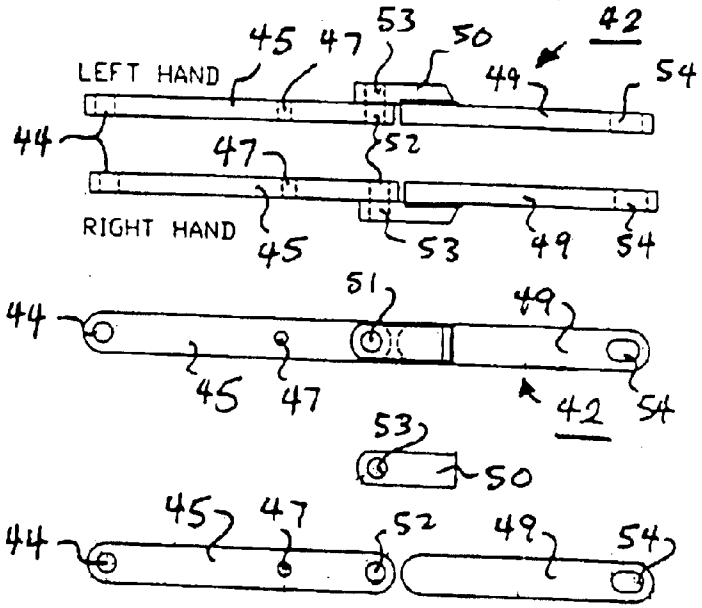
Fig. 14
Fig. 15
Fig. 16
Fig. 17
Fig. 10
Fig. 11
Fig. 12

75
78
77
59
72
70
57
56
73
63
64
67
66
68
79
60
58
29
61
62

HYDRAULICALLY ACTUATED CASING SLIP LIFTER WITH HINGED WRAP ARM ASSEMBLY

BACKGROUND OF THE INVENTION

1. Field of the Invention

This invention relates to a mechanism for lowering a casing slip into a bushing bowl and for subsequently lifting the casing slip out of the bushing bowl, and in particular to a mechanism that uses hydraulic cylinders to lower and raise the casing slip.

2. Description of Related Art

Casing slips have conventionally been lowered into and lifted out of a drilling hole manually. Since casing slip insertion and removal must be repeatedly carried out in order to lock and release successive casing sections during deep well drilling operations, such as oil well drilling, difficulties in removing the casing slips can add significantly to drilling costs.

Devices for automatically lifting and lowering casing slips have previously been proposed, but all require integral or modified bushing bowls and/or casings. Examples of such powered slip assemblies, which integrate the bushing bowl and casing slip, and which lift the casing slip so as to enable removal of at least elements of the casing slip from the integrated bushing bowl, are disclosed in U.S. Pat. No. 4,253,219 (Krasnov); U.S. Pat. No. 3,760,469 (Brown); U.S. Pat No. 2,641,816 (Liljestrand); and U.S. Pat. No. 2,030,087 (Young). While such mechanisms lift the casing slip sufficiently to enable disengagement, they are not capable of lifting the casing slip completely out of the bushing bowl, are relatively complex and/or difficult to implement, and furthermore the mechanisms themselves must be lowered and lifted, resulting in an increase rather than a decrease in the effort required to manipulate the casing slip.

In contrast, the present invention provides a hydraulically actuated lift mechanism that is intended to lift a casing and allow the casing slip to completely clear the bushing bowl, without modifying or integrating the bushing bowl that cams the casing slips into gripping engagement with the casing section. None of the above-cited patents, or any of background U.S. Pat. No. 6,227,587 (Terral); U.S. Pat. No. 4,511,168 (Haynes); and U.S. Pat. No. 4,275,488 (Gray), while U.S. Pat. No. 6,224,112 (Eriksen); U.S. Pat. No. 5,669,653 (Penisson); U.S. Pat. No. 5,301,750 (Watkins); and U.S. Pat. No. 4,340,116 (Weise), discloses such a mechanism.

SUMMARY OF THE INVENTION

It is accordingly a first objective of the invention to provide apparatus for lowering a casing slip into and for lifting a casing slip completely out of a bushing bowl, in order to decrease the effort required to carry out the lowering and raising, increase drilling efficiency, and reduce risks of injury or equipment damage.

It is a second objective of the invention to provide a powered casing slip lift mechanism that can be used with existing casing slips and wellhead configurations.

It is a third objective of the invention to provide a powered casing slip lift mechanism that has a simple construction and is easily manufactured.

It is a fourth objective of the invention to provide a powered casing slip lift mechanism that is simple and safe to use.

These objectives are accomplished, in accordance with the principles of a preferred embodiment of the invention, by providing casing slip lift mechanisms arranged to be pinned in pairs to the rotary bushing prior to the start of a casing job. When each of the pinned mechanisms is in a raised position, casing can be run in conventional fashion without interference. Once the casing joint is lowered to the collar, the slips may be lowered into the bushing bowl by actuating a hydraulic control valve, which lowers the slips into the bushing bowl around the casing, thus locking the casing into place.

The casing slip lifter of the preferred embodiment includes a frame, upper and lower lift arm assemblies, at least one air cylinder connected to a pipe shaft that rotates to pivot the arm assemblies in response to actuation of the air cylinder, and a wrap arm to which the slips are attached and which is coupled to the arm assemblies by a hinge.

According to an especially preferred aspect of the invention, the casing slip lifting mechanism can be pivoted into two alternative raised positions, depending on whether the lower arm assembly is locked by a manually positioned ear lock. The higher position permits the casing slip mechanism to be used when centralizers are installed on the casing.

Finally, the design of the lifter mechanism of the invention may easily be adapted to lift tubing and drill pipes, as well as casing, by simply replacing the wrap arms with arms of appropriately smaller dimensions.

BRIEF DESCRIPTION OF THE DRAWINGS

FIGS. 10 and 11 are side views showing respective retracted and extended positions of the air cylinder illustrated in FIG. 1.

FIG. 12 is a plan view of the air cylinder illustrated in FIGS. 10 and 11.

FIG. 13 is a plan view of the casing slip lifter with locking mechanism and lower arm assemblies removed to better illustrate the position of the upper arm assemblies.

FIG. 14 is a plan view of the left and right upper arm assemblies illustrated in FIG. 13.

FIG. 15 is a side view of one of the upper arm assemblies illustrated in FIG. 14.

FIG. 16 is a disassembled side view of the upper arm assembly of FIG. 15.

FIG. 17 is side view showing the assembled lower and upper arm assemblies together with a hinge and locking mechanism.

DETAILED DESCRIPTION OF THE PREFERRED EMBODIMENTS

Figure 1:
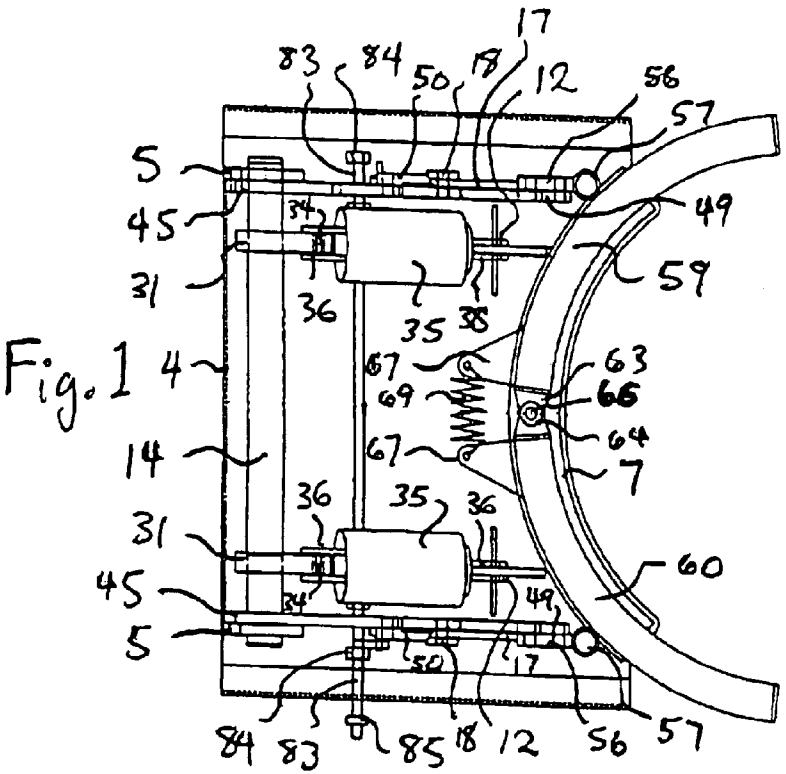
FIG. 1 is a plan view of a casing slip lifter constructed in accordance with the principles of a preferred embodiment of the invention.
Figure 2:
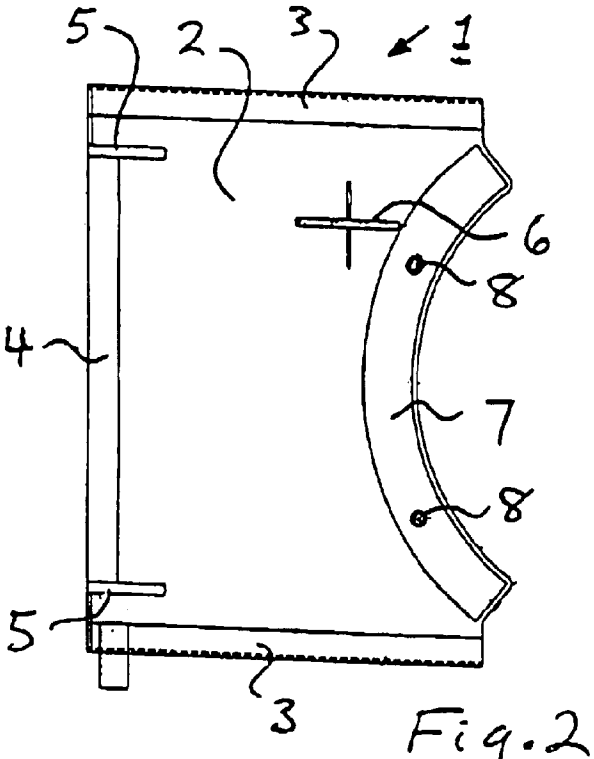
FIG. 2 is a plan view of a frame for supporting the preferred casing slip lifter.
Figure 3:
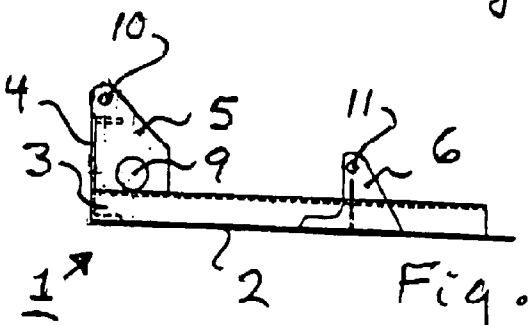
FIG. 3 is a rear elevation of the frame illustrated in FIG. 2.

As illustrated in FIGS. 1–4, the casing slip lifter of the preferred embodiment of the invention includes a frame 1 in the form of a base plate 2 having integral lateral railings 3 to enable transport and positioning of the frame adjacent to the rotary bushing, and a backplate 4 welded to a rear edge of the base plate 2. Arm assembly supports 5 extend vertically from base plate 2 and are welded to edges of backplate 4 and to the base plate 2. Air cylinder supports 6, only one of which is shown in FIG. 2, extend vertically from and are welded to a forward portion of the base plate 2. An arc-shaped reinforcement plate 7 having pin openings 8, through which base plate 2 may be secured to the bushings using appropriately shaped pins (not shown), is fixed to an arc-shaped front edge portion of the base plate 2. Arm assembly supports including openings 9 for receiving pipe-support bearings 15 (FIG. 5), and openings 10 for pivotably securing the upper arm assemblies illustrated in FIGS. 14–16 to the frame via supports 5. Cylinder supports 6 include openings 11 for receiving cylinder coupling pins 12 (FIG. 1).

Figure 4:
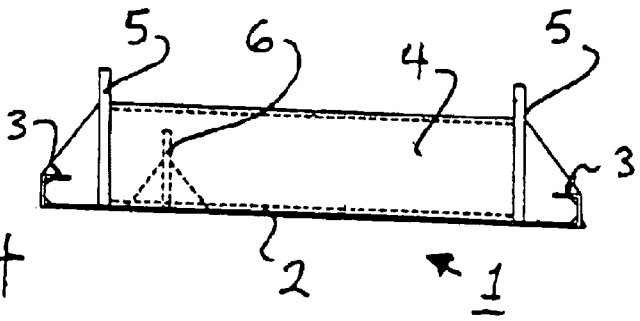
FIG. 4 is a side elevation of the frame illustrated in FIGS. 2 and 3.
Figure 6:
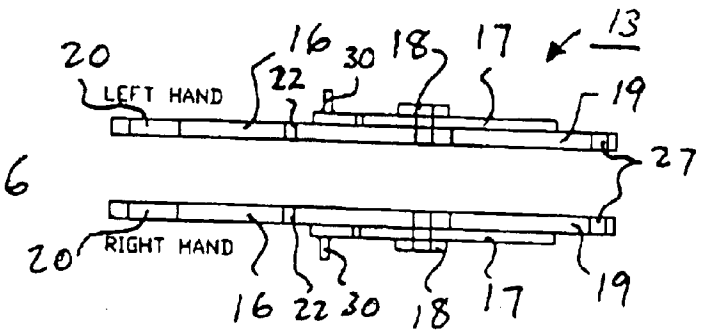
FIG. 6 is a plan view of the left and right lower arm assemblies included in the pipe shaft and lower arm assembly of FIG. 5.
Figure 7:
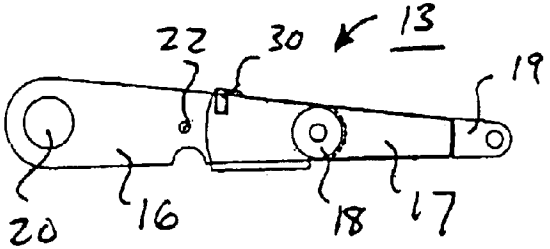
FIG. 7 is a side view of the right hand lower arm assembly illustrated in FIG. 6.
Figure 8:
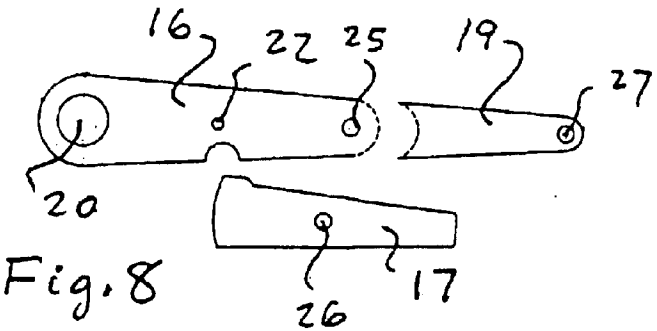
FIG. 8 is a disassembled side view of the right hand lower arm assembly illustrated in FIG. 7.

Those skilled in the art will of course appreciate that the illustrated shapes and manner of attachment of the various frame pieces shown in FIG. 4 are not intended to be taken as limiting, and that the construction of the frame may be varied by those skilled in the art in a variety of ways without departing from the scope of the invention.

Figure 23:
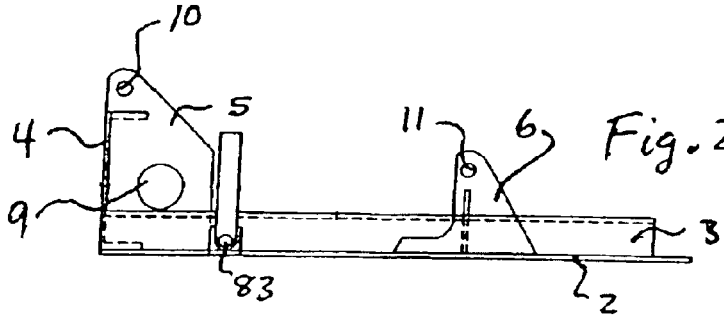
FIG. 23 is a side view of the frame illustrated in FIG. 2, together with a handle for activating the locking mechanism of the preferred embodiment.
Figure 24:
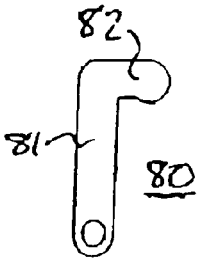
FIG. 24 is a side view of an ear lock used in the preferred locking mechanism.
Figure 25:
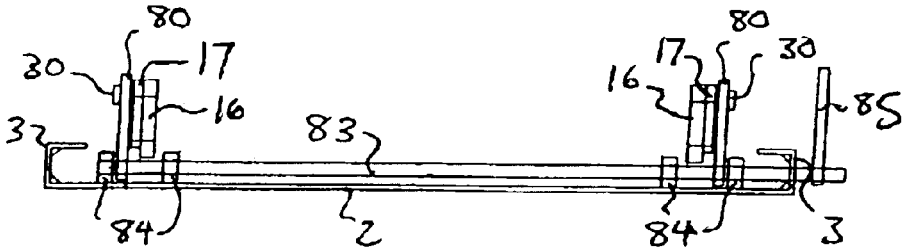
FIG. 25 is an end view of the preferred casing slip lifter, including the ear lock.

As shown in FIGS. 5–8, the lower arm assemblies 13 are each fixedly attached to a pipe shaft 14 supported by bearings 15 extending through openings 9 (FIG. 3) in support plates 5. Each lower arm assembly 13 includes a first lower plate 16 pivotally coupled to a second lower plate 17 by means of pivot pin 18. The second lower plate 17 is fixedly secured to a third lower plate 19. First lower plate 16 includes an opening 20 for an end 21 of pipe shaft 14, an opening 22 for securing a coupling pin 23 for cross-bar 24 (see FIGS. 17 and 26–29), and an opening 25 for receiving the pivot pin 18. Second lower plate 17 includes an opening 26 for the pivot pin 18, and third lower plate 19 includes an opening 27 for receiving a pin 28 for pivotably coupling hinge plate 29 (FIGS. 17 and 26–29) to the lower arm assembly 3. Locking tabs 30, whose function will be described below in connection with FIGS. 23–25, extend laterally from each second lower plate 17.

Figure 5:
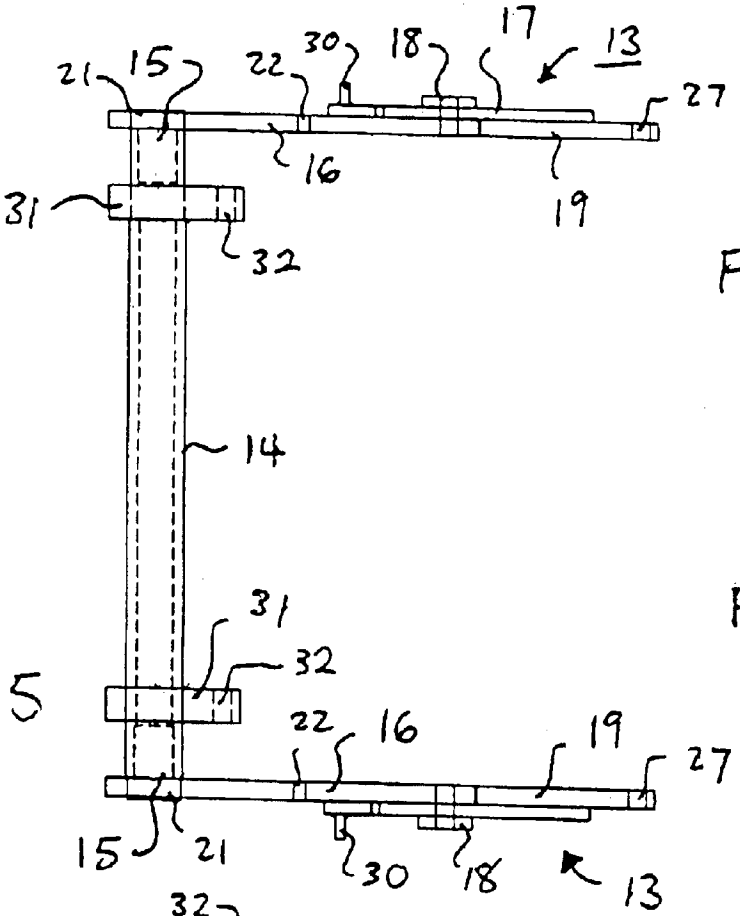
FIG. 5 is a plan view of a pipe shaft and lower arm assembly of the preferred casing slip lifter.
Figure 9:
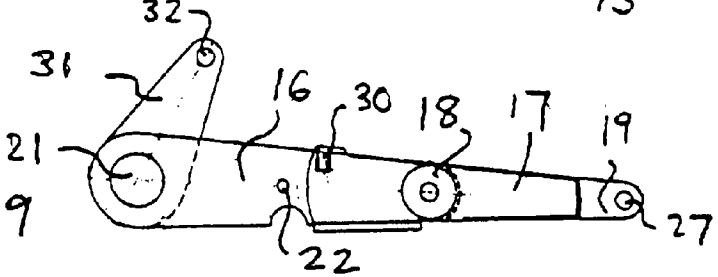
FIG. 9 is a side view showing the relationship between the lower arm assembly and the air cylinder arm used to rotate the lower arm assembly.

As shown in FIGS. 5 and 9, a pair of cylinder arms 31 are fixedly attached to pipe shaft 14. Each of the cylinder arms includes an opening for receiving the pipe shaft 14, and distal openings 32 for receiving an air cylinder coupling pin 34 (FIG. 13). The cylinder arms 31 extend at a fixed angle with respect to first lower plates 16 such that when cylinder arms 31 are pushed by the air cylinders, shaft 14 is rotated to cause pivoting of lower arm assemblies 13.

As illustrated in FIGS. 10–12, air cylinders 35 each includes a pair of arms 36 extending from a first end of the cylinder, a piston 37, and a pair of arms 38 extending from the piston. One of the pairs of arms 36, 38 is secured to cylinder supports 6 by means of pins 12 extending through openings 11 (FIGS. 2–4) and corresponding openings 39 or 40 in the arms 36, 38, and the other pair of arms 36, 38 is secured to the cylinder arm 31 by means of coupling pins 34 extending through openings 32 and corresponding openings 39 or 40. It of course does not matter, for purpose of the general principles of the present invention, whether the piston is on the shaft-side or fixed-support-side of the cylinder, or whether dual pistons are included. As shown in FIGS. 13–17, pivoting of the lower arm assemblies 13 causes pivoting of upper arm assemblies 42, which are secured to the supports 5 by pins 43 extending though support openings 10 (FIG. 3) and openings 44 in first upper plates 45. The upper arm assemblies 42 are coupled to the lower arm assemblies 13 by means of cross-bar 24 secured by coupling pins 46 extending through openings 22 in first lower plates 16 and corresponding openings in the cross bar 24, and openings 47 in the first upper plates 45. In addition, respective ones of the upper arm assemblies 42 are coupled to corresponding lower arm assemblies 13 by means of hinge plates 29 secure by coupling pins 48 extending through elongated openings 54 in third upper plates 49 and openings 56 in hinge plates 29. Second upper plates 50 are pivotally secured to the first upper plates 45 by means of pivot pins 51 extending through respective openings 52 and 53 in the first and second upper plates, while third upper plates 49 are fixedly secured to second upper plates 50 by, for example, welding.

Figures 18, 19, 20, 21, 22:
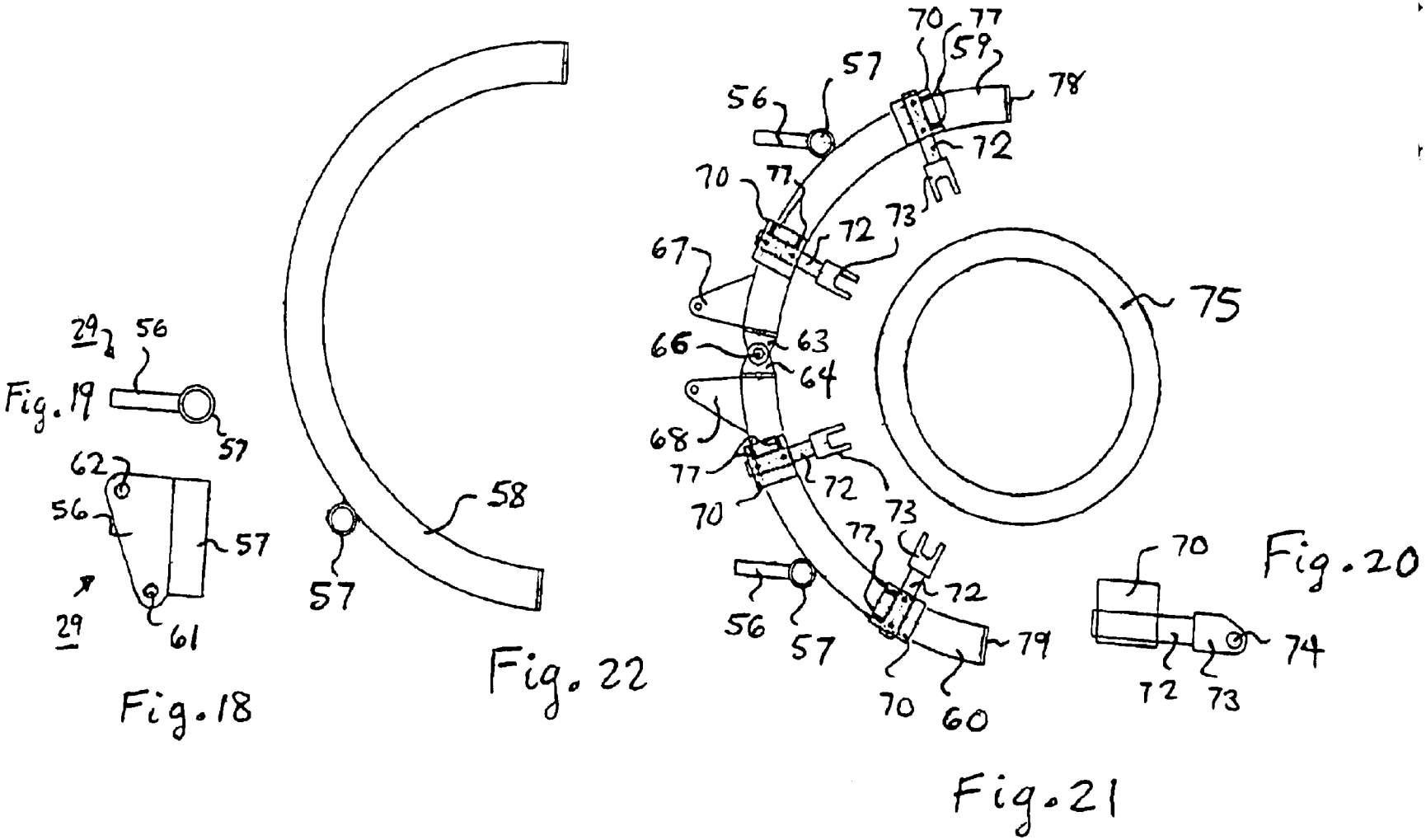
FIGS. 18 and 19 are, respectively, a side view and a plan view of a hinge for use in coupling a wrap arm to the lower and upper arm assemblies of the preferred embodiment.
FIG. 20 is a side view of a grabber arm assembly for use in securing a casing slip to the preferred casing slip lifter.
FIG. 21 is a plan view of a wrap arm and fixtures according to the preferred embodiment of the invention.
FIG. 22 is a plan view of an alternative wrap arm that may be substituted for the wrap arm illustrated in FIG. 21.

As shown in FIGS. 18 and 19, hinge plates 29 each includes a planar section 56 to which is welded a pipe section 57. The pipe section 57 is in turn welded to one of the alternative wrap arms 59, 60 and 58 respectively illustrated in FIGS. 21 and 22. Hinge plates 29 preferably include openings 61 and 62 for respectively receiving pins 28 and 48.

As illustrated in FIG. 21, wrap arm assembly 59, 60 includes wrap arms 59 and 60 secured together by hinge sections 63, 64, which may take the form of a pair of plates 65 extending from one of the wrap arms and a single plate 64 extending from the other wrap arm into the space between the pair of plates, sections 63 and 64 being pivotably coupled by a pin 66. Plates 67 and 68 extend from arm 59 and 60 in this embodiment to secure ends of a bias spring 69 (see FIG. 13), while grabber arm fixtures 70 are mounted on the wrap arms to secure grabber arms 71, illustrated in FIG. 20. Grabber arms 71 include pipes 72 and bifurcated attachment structures 73 having openings 74 for receiving coupling pins (not shown) for coupling to a casing slip (also not shown) that is to be lowered into or raised out of bushing bowl 75. Pipes 72 may be adjustably positioned in openings of fixtures 70 by set screws 77, and threaded into the arm structures. Each of the wrap arms 59 and 60 may be formed by an arc-shaped section of rectangular pipe having a square cross-section and caps 78, 79.

Alternatively, as illustrated in FIG. 22, wrap arms 59, 60 may be replaced by a single wrap arm 90 in the form of an arc-shaped section of pipe having a rectangular cross-section and caps 91 and 92. It will be appreciated that the specific wrap arm and arm assembly configurations illustrated herein are not intended to be taken as limiting, and that the such details as materials and shapes may be varied in numerous ways by those skilled in the art without departing from the scope of the invention.

Figure 29:
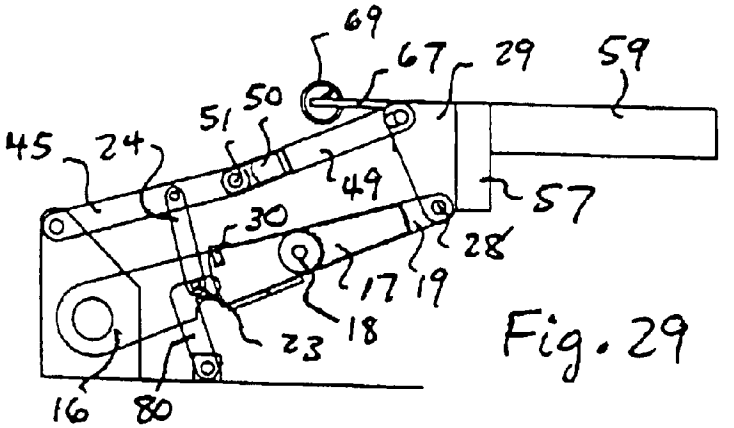
FIGS. 26–29 are side views illustrating, respectively, situations in which the lifter is lowered in the lock position, raised in the lock position, lowered in the unlocked position, and raised in the unlocked position.
Figure 28:
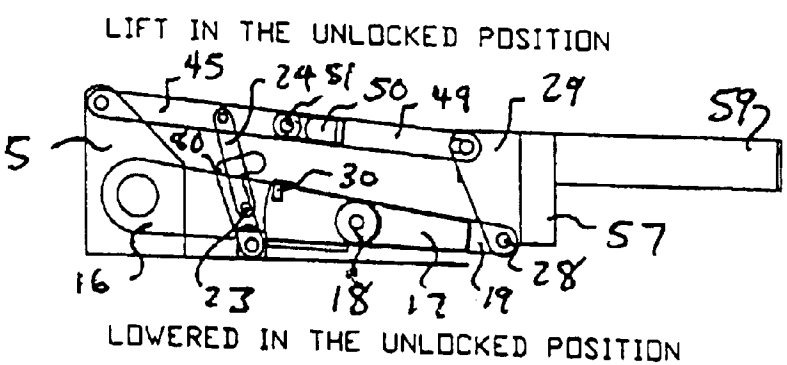
Figure 27:
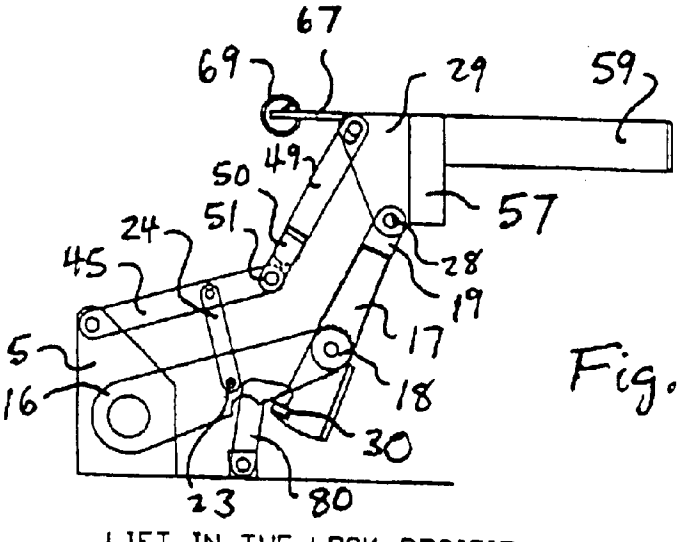
Figure 26:
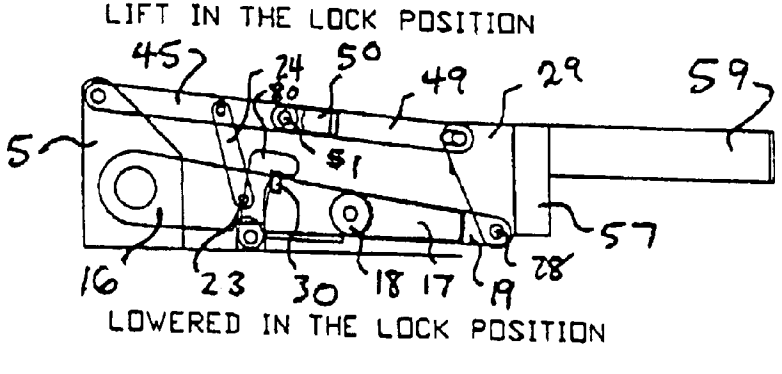

As shown in FIGS. 17 and 23–28, the casing slip lifter of the preferred embodiment includes a lock mechanism that utilizes an ear lock 80 having a vertical leg 81 and a horizontal arm 82 for engaging and latching tab 30 in order to cause the second and third lower latch plates, and consequently the second and third upper latch plates, to pivot relative to each other and extend the vertical travel of the wrap arms 59, 60 or 58, as illustrated in FIGS. 26 and 27. When the tab 30 is not latched, as illustrated in FIGS. 28 and 29, first, second, and third plates of the lower and upper arm assemblies 13 and 42 remain mutually stationary, resulting in reduced vertical travel, as illustrated in FIGS. 28 and 29. Pivoting of the ear lock 80 between the latched and unlatched positions is accomplished by mounting the ear locks on a rod 83 rotatably secured to the base plate 2 by bearing fixtures 84 actuated by handle 85.

Having thus described a preferred embodiment of the invention in sufficient detail to enable those skilled in the art to make and use the invention, it will nevertheless be appreciated that numerous variations and modifications of the illustrated embodiment may be made without departing from the spirit of the invention, and it is intended that the invention not be limited by the above description or accompanying drawings, but that it be defined solely in accordance with the appended claims.

We claim:

1. A lifter for supporting equipment to be lowered into and removed from a well, comprising:

a frame;

at least one hydraulic actuator mounted on the frame;

at least one arm assembly arranged to be pivoted upon actuation of the hydraulic actuator; and a wrap arm hingedly coupled to the at least one arm assembly for supporting equipment to be lowered into and removed from a well, wherein actuation of said hydraulic actuator causes pivoting of said arm assembly, and therefore raising and lowering of a casing slip supported by the wrap arm, wherein said at least one arm assembly comprises a lower arm assembly fixed to a rotatable pipe shaft, the rotatable pipe shaft being coupled to and rotated by said hydraulic actuator to thereby pivot said lower arm assembly, and said lower arm assembly being coupled to an upper arm assembly which is coupled to said wrap arm, whereby actuation of said actuator causes pivoting of said lower and upper arm assemblies, thereby raising and lowering said wrap arm, wherein said lower arm assembly comprises a first lower arm assembly plate fixedly attached to said pipe shaft, and wherein said upper arm assembly includes a first upper arm assembly plate pivotably coupled to a support fixed to said frame, and each of said upper and lower arm assembles includes at least a second plate pivotable with respect to the respective first upper arm assembly and lower arm assembly plates and coupled to each other by a hinge plate fixed to the wrap arm, said second plate of the lower arm assembly include a tab engageable by an ear lock, wherein when said ear lock engages said tab and said first plates of said upper and lower arm assemblies are pivoted, said second plates of said upper and lower arm assemblies pivot with respect to said first upper and lower arm assembly plates to extend a vertical travel of said arm assemblies.

2. A lifter as claimed in claim 1, wherein said ear locks are secured to a rod rotatably secured to a frame and rotatable by a handle.

3. A lifter as claimed in claim 1, wherein said equipment is a casing slip.

* * * * *